United States Patent [19]

Illingworth

[11] Patent Number: 4,899,408

[45] Date of Patent: Feb. 13, 1990

[54] BEDDING SYSTEM

[76] Inventor: Lori D. Illingworth, 7208 Second St., Lakeport, Mich. 48060

[21] Appl. No.: 382,257

[22] Filed: Jul. 19, 1989

[51] Int. Cl.[4] ..... A47G 9/04

[52] U.S. Cl. ..... 5/484; 5/496; 5/497; 5/500

[58] Field of Search ..... 5/497, 484, 496, 500, 5/502, 482, 498, 499

[56] References Cited

U.S. PATENT DOCUMENTS

| | | | |
|---|---|---|---|
| 2,789,292 | 4/1957 | Budinquest | 5/496 |
| 2,963,715 | 12/1960 | Young | 5/497 |
| 3,761,973 | 10/1973 | Leventhal | 5/484 |
| 4,064,577 | 12/1977 | Walters | 5/484 |
| 4,599,756 | 7/1986 | Koffler | 5/484 |

*Primary Examiner*—Alexander Grosz
*Attorney, Agent, or Firm*—Owen J. Meegan

[57] ABSTRACT

A bedding attachment system especially for use with a baby crib. The system includes a coverlet adapted to be disposed about top, head foot and side panels and at least the peripheral edges of the top and bottom panels of a mattress. The coverlet includes an upper peripheral edge disposed about the perimeter of the top panel and terminating in a pair of opposing upper and lower flaps having inner and outer surface areas. It further includes a base sheet attached to the lower flap and having an area substantially co-extensive with and overlying the top panel. Flexible fastening devices such as the well known hook and loop arrangements are disposed upon the inner surface of the opposing flaps for detachably securing the flaps to a cover sheet. The flaps are adapted to releasably secure the peripheral edge of the cover sheet and hold it in an overlying relationship to the base sheet. A lower peripheral edge is disposed about the perimeter of the bottom panel and a mechanism is included for releasably securing the lower peripheral edge in position about the perimeter of the lower panel of the mattress. Lastly, an intermediate panel is attached to the upper and lower peripheral edges and it extends continuously about the foot, head and side panels of the mattress.

14 Claims, 2 Drawing Sheets

BEDDING SYSTEM

FIELD OF THE INVENTION

The present invention relates to bedding and more particularly to an improved bedding system which permits fitted a sheet, liner and pad to be quickly and conveniently secured in place on and removed from a mattress. The invention especially concerns a bedding system that may be used on a baby's crib.

BACKGROUND OF THE INVENTION

In order to protect the mattress on an infant's bed or crib, though not limited thereto, a usual practice is to place a waterproof sheet directly on top of the mattress and a fabric cover sheet on top of the waterproof sheet to form the undercover of the bedding. Generally, the waterproof sheets employed are of rubberized fabric, rubber, plastic, or other flexible water-impervious material, and they are usually of a size such that the cover sheet can be tucked under on all sides of the mattress between the mattress and the spring of the crib, frequently together with an upper fabric sheet. Moreover, it may be desirable to also place a mattress pad between the waterproof sheet and the cover sheet so as to absorb any moisture that may be present due to the inability of the cover sheet to absorb all of the moisture. The making of an infant's crib frequently involves disposing fitted or contour sheets over the waterproof sheet and around the sides of the mattress upon which the waterproof sheet is disposed. Again, the mattress pad can be disposed between the contour sheet and the waterproof sheet.

The arrangements, however, are not entirely satisfactory. For example, if the sheets are not tucked securely under the mattress, normal movements of an infant often tend to displace the cover sheet, the pad and the waterproof sheet. Further, when it is necessary to replace the cover sheet, the cover sheet and the pad have to be removed, and the mattress has to be lifted from a support spring so that a fresh cover sheet and pad can be retucked beneath the mattress over the waterproof sheet.

Additionally, where a baby's crib is involved which has conventional side bars and bumpers arranged upon the interior of the crib, and especially where, for example, the sheet must be changed a number of times during the day or night, considerable difficulty can be experienced in removing the sheet and reassembling the arrangement.

Oftentimes, with the conventional bed sheet attachments to mattresses, particularly for cribs but not necessarily limited thereto, the assembly of the replacement sheet requires difficult manual lifting of portions of the mattress for proper wrap around or disposition of the sheet thereon.

In the prior art, there are numerous devices and assemblages for securing beddings to mattresses, beds and the like.

The state of the art is exemplified in the following U.S. Pat. Nos.

| | | | |
|---|---|---|---|
| 2,660,735; | 3,066,321; | 3,066,323; | 3,308,490; |
| 3,654,059; | 4,045,832; | 4,216,774; | 4,301,561; |
| 4,301,561; | 4,316,299; | 4,413,368; | 4,445,242; |
| 4,488,323; | 4,627,363. | | |

While such prior art devices provide improvement in the areas intended, there still exists a great need for an improved bedding attachment system of a character which is simple in construction and efficient in use.

Accordingly, a principal object of the present invention is to provide a new and improved bedding attachment system having the foregoing characteristics.

Another object of the present invention is to provide a bedding attachment system which permits cover sheets, pads and the like to be readily and conveniently placed upon, and thereafter changed, without having to lift corners of the mattress or move the bed or crib, as the case may be, away from the wall.

A still further object of the present invention is to provide a bedding attachment system which minimizes the time and difficulty required to change bedding.

Another object of the present invention is to provide an improved bedding attachment system which inhibits a young child or baby from easily disassembling the bedding structure while in the crib.

These and other objects of the invention will in part appear hereinafter and will in part become apparent after consideration of the specification with reference to the accompanying drawings and the claims.

SUMMARY OF THE INVENTION

Briefly, the bedding attachment system in accordance with the present invention is employed with a conventional mattress that has a top, bottom, head, foot and opposing side panels. The system includes a coverlet adapted to be disposed around and about the head, foot and side panels and at least the peripheral edges of the top and bottom of the mattress.

The coverlet comprises an upper peripheral edge means disposed about the perimeter of the top panel and terminating in a pair of opposing upper and lower flap members having inner and outer surface areas. A base sheet member preferably formed of a waterproof pad is attached adjacent to the lower flap member and has an area substantially coextensive with and directly overlies the top panel of the mattress. Fastening means are disposed upon the inner surface of the opposing flap members for detachably securing a cover sheet member to the coverlet. The flap members are adapted to releasably secure the peripheral edge of the cover sheet member so as to hold it in overlying relationship to the base sheet member. The coverlet further includes a lower peripheral edge means adapted to be disposed about the perimeter of the bottom panel of the mattress. The lower peripheral edge means is preferably provided with an elastic means for releasably securing the lower peripheral edge in a fixed position about the perimeter of the lower panel of the mattress. An intermediate member is attached to the upper peripheral edge means and the lower peripheral edge means. The intermediate member extends continuously about the foot, head and side panels of the mattress. In general, the shape of the coverlet is similar to a contour sheet in which an elastic engagement of the bottom of the mattress is provided. In a preferred embodiment, the cover sheet is formed of a napped lint Nylon (TM) polyester fabric whereby the fastening means can be hooks such as commonly found with Velcro (TM) hook and loop fastening assemblies. The hooks engage the nap of the fabric directly. The hook portions of Velcro fasteners are described in U.S. Pat. No. 2,717,437.

BRIEF DESCRIPTION OF THE DRAWING

For a fuller understanding of the nature and desired objects of the invention, reference should be had to the following detailed description taken in conjunction with the accompanying drawings wherein like reference characters denote corresponding parts throughout the several views and wherein.

DESCRIPTION OF THE PREFERRED EMBODIMENT

Figure 1:
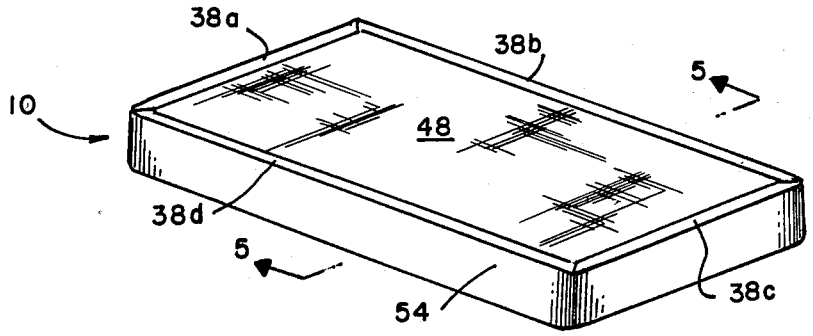
FIG. 1 is a perspective view of a bedding attachment system embodying the principals of the present invention attached to a typical crib mattress.
Figure 2:
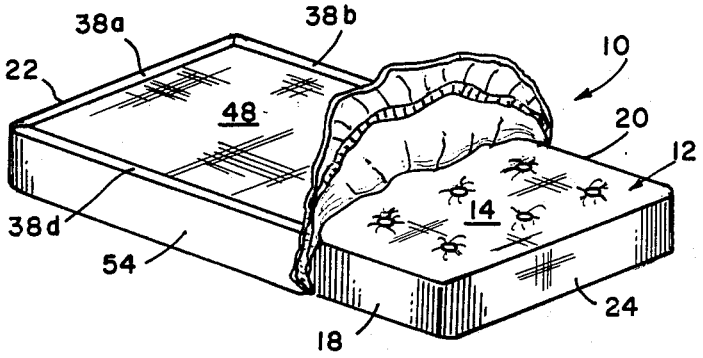
FIG. 2 is a perspective view similar to FIG. 1 but having a portion of the bedding attachment system detached from the mattress and folded back for a more clear illustration of the attachment.
Figure 3:
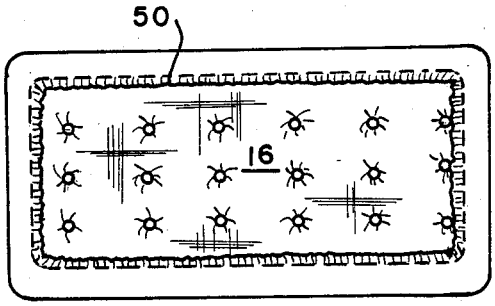
FIG. 3 is a plan view of the underside of the structure shown in FIG. 1.

Referring now more particularly to the drawings, there is shown in FIGS. 1–3 a bedding attachment system, generally indicated at 10, mounted upon a conventional crib mattress 12. It is to be understood that while the present invention is described with respect to the application to crib mattresses for simplicity, it is not limited thereby and is equally applicable to other mattresses. The mattress 12 includes a horizontally disposed generally flat upper or top panel surface area 14 on which a child may repose. A generally flat bottom or lower panel surface area 16 is disposed parallel to the top panel and generally vertically oriented head panel surface area 22 (not shown) and foot panel surface area 24, all of an appreciable thickness spanning between the top and bottom panels and continuously extending around the mattress 12.

Figure 4:
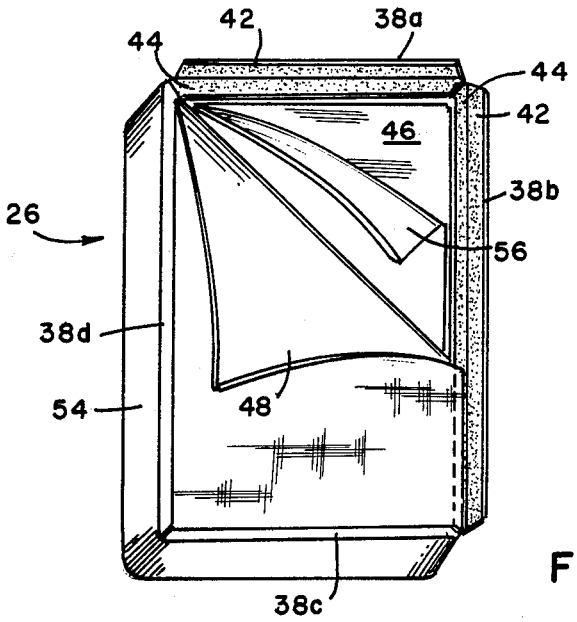
FIG. 4 is a perspective of an embodiment of the present invention mounted upon a typical crib mattress and having one corner detached and folded back for a more clear illustration.
Figure 5:
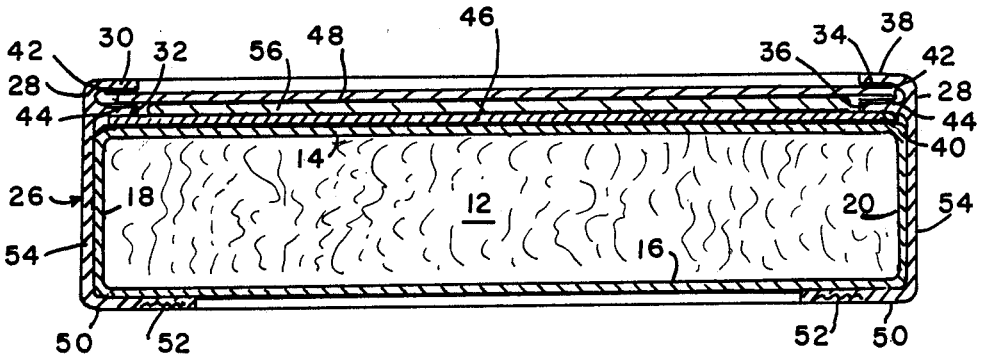
FIG. 5 is an enlarged cross-sectional view taken along the line 5—5 of FIG. 1.

Referring now more particularly to FIGS. 4 and 5, the bedding attachment system embodying the principals of the present invention comprises a coverlet indicated generally by the numeral 26. The coverlet 26 comprises an upper peripheral edge 28 disposed about the perimeter of the top panel 14 of the mattress and which terminates in a pair of opposing upper and lower flap members 30 and 32, respectively. Each flap member has inner surfaces 34, 36 and outer surfaces 38 and 40. In the preferred embodiment, the upper flap member is formed as four elongated sections 38 *a–d* which extend lengthwise about the perimeter of the top panel 14. The fastening means preferably comprises strips 42 of hook fastening material attached to the inner surface 34 of the flap members 38 *a–d*. Similarly, strips 44 of hook material are attached to the inner surface 36 of the lower flap member 32. The strips 42 and 44 can be attached by conventional means such as sewing or adhesives.

A base sheet member 46 is attached to the lower flap member 36 and has an area substantially coextensive in area with the top panel 14. The base sheet member 46 is preferably formed of a moisture proof plastic material and can be attached to the lower flap member by conventional threading, adhesives or mating hook and loop strips (not shown).

A cover sheet member 48 is disposed over the base sheet member 48 in overlying relationship and substantially co-extensive therewith. The cover sheet 48 member is releasably secured in position between the upper and lower flap members 30 and 32, and held there with the hook portions of the hook and loop fastening system. The cover sheet member 48 can be formed of a suitable napped polypropylene fabric material. The fabric can have a decorative design as well as being moisture proof.

The lower peripheral edge 50 is disposed about the perimeter of the bottom panel surface 16 and is provided with suitable releasable securing means 52 such as, for example, an elastic material, to releasably secure the lower peripheral edge in position about the bottom panel 16.

Disposed between and joining the upper peripheral edge 28 and the lower peripheral edge 50 of the coverlet 26 is an intermediate member 54 which extends vertically and continuously about the head panel 22, foot panel 24 and side panels 18 and 20. The intermediate member can be formed of a fabric material which can also be moisture proof. Additionally, it is to be understood that the peripheral edges and intermediate member is preferably arranged as a form fitted system to accommodate particular sizes of mattresses.

In an alternate embodiment of the invention, a bed pad member 56 can be disposed between the base sheet member and the cover sheet member.

One feature of the present invention is that a small child or baby is prohibited from easily disassembling the bedding attachment system of the present invention. Even if the child should lift an upper flap member, it is extremely difficult to get his or her fingers under the cover member 48 since it is held in place by the hook strip disposed on of the lower flap member.

Another feature of the present invention is that an adult, while holding a child in one arm, can disassemble the bedding attachment system with the other hand (as shown in FIG. 4) and exchange the various components, such as the cover sheet member 48 and bed pad 56, and reseal the same quickly and fairly easily.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing, shall be interpreted as illustrative and not in a limiting sense.

As my invention, I claim:

1. A bedding attachment system comprising:

a coverlet adapted to be disposed about top, head, foot and side panels and at least the peripheral edges of the top and bottom panels of a mattress, said coverlet comprising:

an upper peripheral edge means arranged to be disposed about the perimeter of the top panel of the mattress and terminating in a pair of opposing upper and lower flap members having inner and outer surface areas, said flap members being arranged to be disposed on said top panel of said mattress;

fastening means disposed upon the inner surface of each of the opposing flap members, said flap members adapted to releasably secure the peripheral edge of a cover sheet member and arranged to be held in overlying relationship to said mattress;

an intermediate member attached to said upper peripheral edge means, said intermediate member extending continuously about the foot, head and side panels of said mattress.

2. The bedding attachment system according to claim 1 further including a base sheet member attached to the lower flap member and having an area substantially co-extensive with and overlying said top panel.

3. The bedding attachment system in accordance with claim 2 wherein said base sheet member is formed of a waterproof material.

4. The bedding attachment system in accordance with claim 2 wherein said assembly further includes a waterproof bed pad disposed between the base sheet member and a cover sheet member and thereby releasably held in position adjacent the top panel of the mattresses.

5. The bedding attachment system according to claim 1 further including a lower peripheral edge means disposed about the perimeter of the bottom panel, and means for releasably securing the lower peripheral edge in position about the perimeter of the lower panel.

6. The bedding attachment system in accordance with claim 1 wherein said fastening means comprises a first strip of hook fastening material extending about the inner surface of the upper flap member and a second strip of hook fastening material extending about the inner surface of the lower flap member.

7. The bedding attachment system in accordance with claim 1 wherein said assembly further includes a cover sheet member releasably attached between the upper and lower flap members and having an area co-extensive with the upper peripheral edge of the coverlet.

8. The bedding attachment system in accordance with claim 7 wherein said cover sheet is formed of a napped polypropylene fabric.

9. The bedding attachment system in accordance with claim 1 wherein said means for releasably securing the lower peripheral edge is an elastic means.

10. A bedding attachment system comprising:

a coverlet adapted to be disposed about the top, head, foot and side panels and at least the peripheral edges of the top and bottom panels of a mattress, said coverlet comprising:

an upper peripheral edge means disposed about the perimeter of the top panel and terminating in a pair of opposing upper and lower flap members having inner and outer surface areas;

a base sheet member attached to the lower flap member and having an area substantially co-extensive with and overlying the top panel of said mattress;

fastening means disposed upon the inner surfaces of the opposing flap members;

a cover sheet member adapted for positioning over the base sheet member, said flap members adapted to releasably secure the peripheral edge of the cover sheet member in overlying relationship to the base sheet member;

a lower peripheral edge means disposed about the perimeter of the bottom panel;

means for releasably securing the lower peripheral edge in position about the perimeter of the lower panel; and an intermediate member attached to said upper peripheral edge means and said lower peripheral means, said intermediate member extending continuously about said foot, head and side panels.

11. A bedding attachment system comprising:

a coverlet adapted to be disposed about the head, foot, side and top panels and at least the peripheral edge of the bottom panel of a mattress, said coverlet comprising:

an upper peripheral edge means disposed about the perimeter of the top panel and terminating in a pair of opposing upper and lower flap means extending horizontally inwardly toward the center of said top panel and having inner and outer surface areas;

a base sheet member attached to the lower flap member having an area substantially co-extensive with and overlying the top panel, said upper flap means comprising at least four elongated sections extending lengthwise along the perimeter of the top panel;

fastening means disposed upon the inner surfaces of the opposing flap members;

a cover sheet member adapted for positioning over said base sheet member, said flap members adapted to releasably secure the peripheral edge of the cover sheet member in overlying relationship to the base sheet member;

a lower peripheral edge means disposed about the perimeter of the bottom panel;

means for releasably securing the lower, peripheral edge in position about the perimeter of the bottom panel; and an intermediate member attached to said upper peripheral edge means and said lower peripheral edge means, said intermediate member extending continuously about said foot, head and side panels.

12. A bedding attachment system comprising:

coverlet adapted to be disposed about the head, foot, side and top panels and at least the peripheral edge of the bottom panel of a mattress, said coverlet comprising:

an upper peripheral edge means disposed about the perimeter of the top panel and terminating in a pair of opposing upper and lower flap means extending horizontally inwardly toward the center of said top panel and having inner and outer surface areas;

a base sheet member attached to the lower flap member having an area substantially co-extensive with and overlying the top panel, said upper flap means comprising at least four elongated sections extending lengthwise along the perimeter of the top panel;

fastening means disposed upon the inner surfaces of the opposing flap members for detachably securing the flap members to a cover sheet member adapted for positioning over said base sheet member, said flap members adapted to releasably secure the peripheral edge of the cover sheet member in overlying relationship to the base sheet member;

a bed pad disposed between the base sheet member and the cover sheet member;

a lower peripheral edge means disposed about the perimeter of the bottom panel;

an intermediate member attached to said upper peripheral edge means and said lower peripheral edge means, said intermediate member extending continuously about said foot, head and side panels.

13. The bedding attachment system according to claim 12 wherein the fastening means is formed of plastic hooks disposed on a fabric substrate.

14. The bedding attachment system in accordance with claim 12 wherein said cover sheet is formed of a napped polypropylene fabric.

* * * * *